United States Patent [19]

Carstens

[11] Patent Number: 4,798,293

[45] Date of Patent: Jan. 17, 1989

[54] SHIRT FOLDING AND PACKAGING METHOD AND APPARATUS

[76] Inventor: Ronald Carstens, 209 Edith Point, Anacortes, Wash. 98211

[21] Appl. No.: 188,198

[22] Filed: Apr. 28, 1988

Related U.S. Application Data

[63] Continuation of Ser. No. 869,713, Jun. 2, 1986.

[51] Int. Cl.[4] ..... B65D 73/00

[52] U.S. Cl. ..... 206/495; 206/292; 206/492; 223/71

[58] Field of Search ..... 206/278, 292, 293, 294, 206/492, 495, 813; 223/68, 70, 71, 83; 2/132

[56] References Cited

U.S. PATENT DOCUMENTS

| | | | |
|---|---|---|---|
| 1,805,076 | 5/1931 | Carlston | 223/71 |
| 1,816,539 | 7/1931 | Lerman | 223/71 |
| 1,872,260 | 8/1932 | Elzey | 223/83 |
| 2,620,950 | 12/1952 | Jacobson | 223/71 |
| 2,870,945 | 1/1959 | Steele | 223/83 |
| 3,088,117 | 5/1963 | Baker | 2/132 |
| 3,865,286 | 2/1975 | Tiss | 223/83 |
| 3,908,823 | 9/1975 | Smith | 223/71 |

FOREIGN PATENT DOCUMENTS

| | | | |
|---|---|---|---|
| 77319 | 8/1950 | Norway | 223/71 |
| 87090 | 9/1953 | Norway | 223/83 |

*Primary Examiner*—David T. Fidei

*Attorney, Agent, or Firm*—Holman & Stern

[57] ABSTRACT

A shirt is packaged on a flexible shirt board without the need for pins or clips to maintain the integrity of the folded shirt by using a shirt board which is coated with a transient adhesive. In the folding process portions of the skirt are adhered to the transient adhesive by a steam iron. A transient adhesive coated collar board may also be used to support the shirt collar. To unpackage the skirt, it is simply unfolded and pulled away from the shirt board at the adherent portions. A preferred form of transient adhesive for use in the process is also disclosed.

13 Claims, 4 Drawing Sheets

SHIRT FOLDING AND PACKAGING METHOD AND APPARATUS

This is a continuation of application Ser. No. 869,713, filed June 2, 1986.

BACKGROUND OF THE INVENTION

This invention relates generally to the preparation and packaging of shirts, blouses and like articles for presentation and sale to the public. For simplicity, hereinafter, such articles will be referred to generically as shirts.

Traditionally, shirts, particularly dress shirts, are packed individually in flat rectangular plastic or like bags. For attractive and tidy presentation, each shirt is folded into rectangular form on a sheet of lightweight flexible board known as a shirt board, often with tissue paper included, and the shirt collar is supported by an associated collar board interposed between the collar and the collar band, frequently with additional collar stays and supports at the front of the collar. To maintain the integrity of the folded shirt package, mechanical fasteners such as pins or clips are normally used. The shirt folding, fastening and packaging operation is a complex one, performed manually, and involving a number of different steps, considerable skill, experience, and hand-eye coordination if it is to be carried out at an economical rate in modern day shirt factory production. Moreover, the subsequent unpackaging of the shirt by a consumer is also somewhat time consuming, involving, inter alia, the location and removal of all the pins and/or clips, and the precise location and number of these may vary somewhat from manufacturer to manufacturer. Also, disadvantages are apparent in the use of pins, noteably their propensity to cause pinpricks both to a packaging operative and to the consumer, and the formation of holes in the shirt. While the use of clips may obviate these disadvantages to an extent, they may not be as secure or as rapidly applied as pins.

SUMMARY OF THE INVENTION

General objects of the invention include the provision of a new or improved shirt folding and packaging method, new or improved apparatus for use therein, and a new or improved package resulting from the use thereof.

A more specific object of the invention is the provision of a shirt folding and packaging technique which obviates the use of mechanical fasteners.

Another object of the invention is the provision of a packaged shirt which is simple and quick to unpack and unfold without having to locate and remove mechanical fasteners.

A further object of the invention is the provision of a novel form of shirt board and collar board which facilitate the shirt folding and packaging process.

Still another object of the invention is the provision of a shirt folding and packaging process which is simple and economical to perform.

To achieve the above and other various objects, the invention, broadly stated, contemplates the use of a chemical transient bonding composition as a temporary fastening means between various portions of a shirt, the shirt board, and the collar board, in a shirt folding and packaging process, in place of the previously used mechanical means. Thus, at least in a preferred form of the invention, there is provided a specially adapted shirt board and collar board, each of which are coated at least over strategic portions thereof, with the transient bonding composition. In carrying out the inventive process, a shirt is folded about the collar board and shirt board in a series of folding operations, and portions of the shirt are transiently bonded to the respective boards by the strategic application of pressure, and/or moisture and/or heat as between the shirt and board, dependent on the type of transient adhesive which is used. For example, for an adhesive requiring moisture to activate same, the bonding process may be accomplished by means of a steam iron.

The process, which is relatively simple to learn and perform, produces a packaged shirt of extremely neat and tidy appearance, with no mechanical fasteners, and which is therefore also extremely simple for a purchaser to unpackage simply by pulling the shirt away from the boards, the adhesive preferably being such that it has substantially no permanent adherence to the shirt.

The term "transient" adhesive is used to denote an adhesive which is of a temporary nature as opposed to permanent bonds of usually long duration which generally cannot be unbonded without damage to the bonded surfaces. Numerous transient adhesives are known, but in carrying out the invention one useful material is a transient adhesive of the general type disclosed in copending patent application Ser. No. 807,748, filed Dec. 11, 1985, which consists essentially of about 5–25% (w/v) sol of polyvinyul pyrollidone (PVP) in an organic solvent having a boiling point less than 90° C. under normal atmospheric conditions, e.g. methanol or isopropanol said PVP having a molecular weight ranging from about 30,000 to about 90,000 the resulting composition being a transient cohesive. The disclosure of the copending patent application is expressly incorporated herein by reference.

An adhesive of the type disclosed in the copending application, which has been suitably applied to a shirt board and collar board in a manner disclosed in the copending application, and has subsequently dried thereon, requires moisture in order to activate same and, in a process according to the present invention, this may conveniently be supplied by a steam iron which is used to press the shirt to the boards. Alternatively, the process may be conducted in a humid atmosphere (about 60–80% humidity) in which case a regular iron can be used.

Although adhesives of the type specifically disclosed in the copending appliction are desirable for use in the invention, other transient adhesives are also considered suitable. Thus, the collar and shirt boards can be coated, for example, with different chemical polymer coatings such as water-soluble acrylics like Carboset resins or styrene-butadiene resins (SBR). Such coatings should be water soluble and have a suitable glass transition temperature (Tg) (or melting point).

SBR latexes of various genre were utilized in the instant invention with varying results. Most all of the SBRs with appropriate Tg provided a tacky surface after coating the board such that the shirt materials adhered to it. These then constitute one class of materials which could be utilized. The major disadvantage of SBRs was that sometimes the tack was too strong and the material transferred to the shirt, leaving an undesirable sticky residue.

In contract, PVP type coatings gave a dry tack-free coating, but in some instances these had to have either high humidity (for remoistening) or steam to make them bond to the shirt material. Under these conditions there were instances where the bond was too tenacious and fibre was pulled from the board on to the shirt surface, which was undesirable.

Plasticizers and humectants and combinations were tried with varying degrees of success. However, the best method thus far discovered was a combination of PV and SBR, combining the best properties of both materials. For instance, a mixture containing two to forty percent PVP and SBR latexes, when applied as a coating to the shirt board substrate, gave a nearly ideal balance of properties in that the shirt could be ironed on to the board, thereby effecting a bond which was essentially tack-free and, when separated under varying conditions of heat and humidity, produced residue-free shirts that exhibited good bonding characteristics to the substrate.

Preferred materials have a Tg of between about 40° C. and −5° C. A particularly preferred composition comprised a mixture of about 5 to about 15 weight percent PV K-90 (90,000 MW) and an SBR latex such as Dow 238 or Dow 277 (carboxylated styrene-butadiene latexes) applied wet at 1–3 mils.

It should be understood that the foregoing is illustrative of useful transient cohesives and, while these materials are highly useful and desirable, those skilled in this art could readily select alternative materials within the scope of this invention.

In carrying out the invention, use may be conveniently be made of a folding table having a work surface with a collar receiving recess therein incorporating and adjustable-diameter heated neck die, and a swing down folding plate pivotally mounted over the surface adjacent the recess.

Additional features and advantages of the invention will become apparent from the ensuing description and claims when read in conjunction with the accompanying drawings.

DESCRIPTION OF PREFERRED EMBODIMENT

Figure 2:
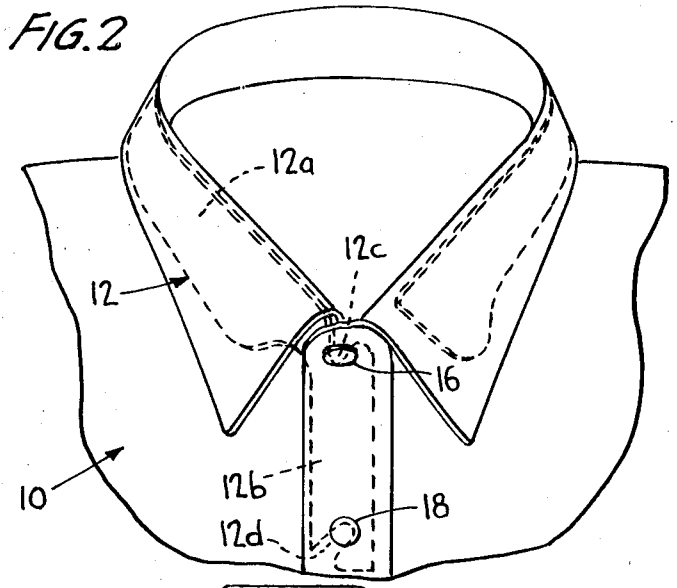
FIG. 2 is an elevational view of the top part of a shirt including the collar showing the in use location of the collar board.

Generally stated, a shirt 10 which is shown in the drawings as a conventional form of long sleeve dress shirt, may be folded and packaged in accordance with the invention, without the need for mechanical fasteners, by the use of a specialized collar board 12, and a specialized shirt board 14, the folding being performed on a folding table 16.

Figure 1:
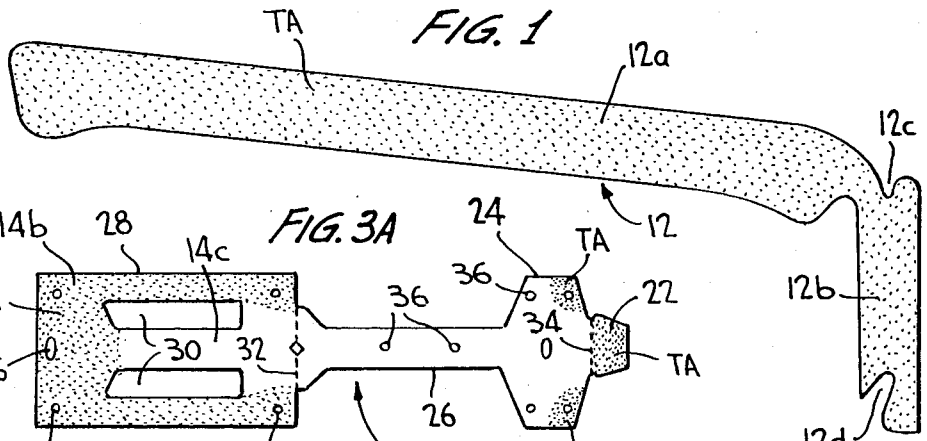
FIG. 1 is a view on one surface of a collar board for use in accordance with the invention in a shirt folding and packaging process.

The collar board 12, see FIG. 1, may conveniently comprise an elongate collar band-encircling portion **12*a* and a shorter shirt front portion 12*b* at an angle to the encircling portion. The shirt front portion is provided with upper and lower button-receiving notches 12*c* and 12*d*, spaced apart a distance conforming to the generally standard spacing between the collar button 16 of the shirt and the next button down 18**. Both surfaces of the collar board are coated with a transient adhesive possibly of the type and in the manner disclosed in the aforementioned copending application, and which has subsequently dried on the board, so that it requires moisturization or humidification to allow transient bonding. Alternatively, other adhesives, as indicated above could be substituted therefor with the methodology revised accordingly.

Figure 3:
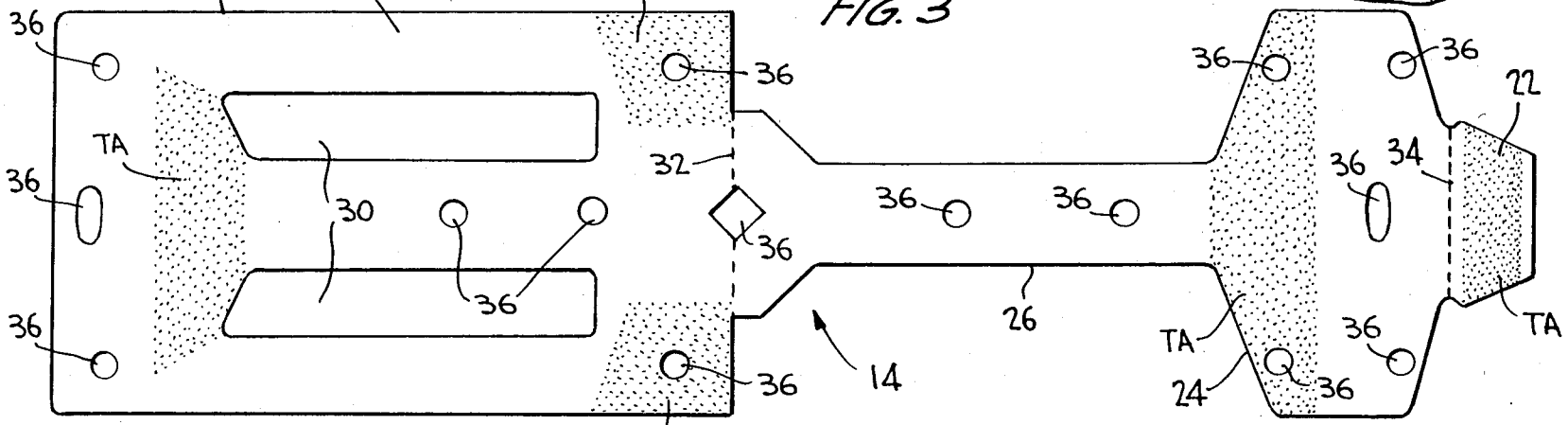
FIG. 3 is a view on one surface of a shirt board for use in the process.
Figure 3A:
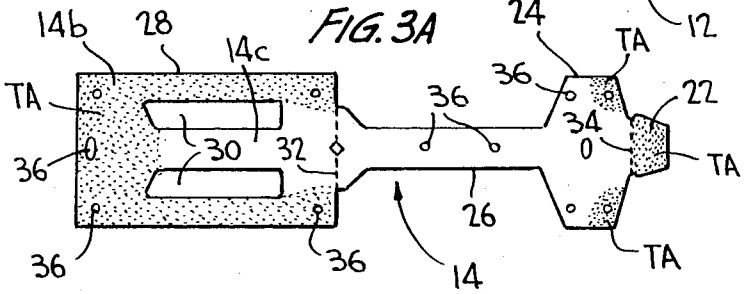
FIG. 3A is a view to a reduced scale on the other surface of the shirt board.

Shirt board 14 may include a collar tab 22, a shoulder portion 24, an elongate spine portion 26, and a body portion 28. The body portion is of rectangular form with cutouts 30, and preferably is about the same size as a standard shirt board commonly used in shirt packaging. It is connected to the spine portion by a transverse fold line 32. The spine portion 26 and shoulder portion 24 together conform in height to the body portion 28. The shoulder portion may be connected to collar tab 22 by another transverse fold line 34. The shirt board may be portion with further small-size cutouts 36 which reduce weight and serve as steam transmission ports. On one surface **14*a*, as shown in FIG. 3, the shirt board is coated with transient adhesive TA in the same manner as collar board 12, along the collar tab 22, along the bottom half of the shoulder portion 24, at the top corners of the body portion 28, and as a strip toward the bottom of the body portion. On its opposite surface 14*b*, as shown in FIG. 3A, the shirt board is coated with transient adhesive TA over the collar tab 22, at the top corners of the shoulder portion 24, and over substantially the entire area of body portion 28 except for central strip 14*c***.

The first step in folding and packaging shirt 10 in accordance with the invention, is to encircle the collar band with portion **12*a* of the collar band, fold over the shirt collar, fit notches 12*c* and 12*d* of the collar band over buttons 16 and 18 as shown in FIG. 2, and button the front of the shirt over portion 12*b* of the collar board. Then, the shirt is transferred to table 16 as shown in FIG. 4**.

Table 16 may form part of a conventional type of shirt folding machine, being provided adjacent one end with a collar opening 38 having an expanding, heated generally triangular-shaped collar mandrel 40 in the opening. A metal plate 42 is pivotally mounted on the table over the collar opening.

Figure 4:
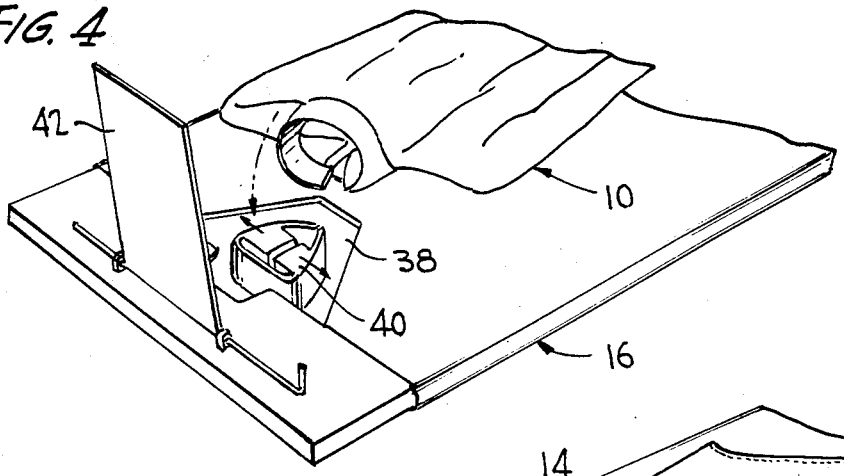
FIGS. 4 and 5 are perspective views of a shirt folding table showing, in sequence, the initial stages of its use in the shirt folding and packaging process.
Figure 5:
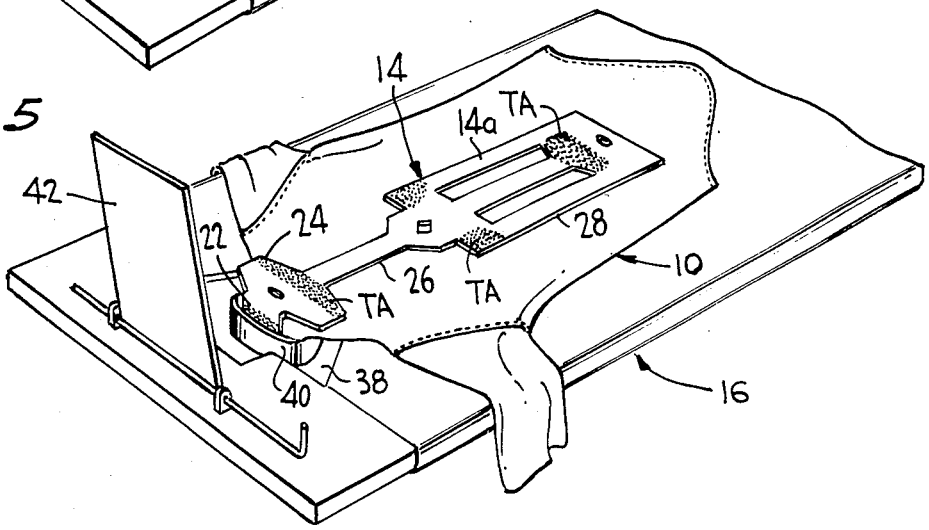

As shown in FIG. 4, the shirt is placed, front down, on the table and the collar is placed over mandrel 40 with plate 42 elevated. The shirt is opened out and straightened on table 16, and then, as shown in FIG. 5, shirt board 14 is placed on the back of the shirt with surface **14*a* facing up and with collar tab 22 folded down and inserted under the back of the collar board. Heat and external pressure from the mandrel 40 is effective to press the shirt collar to an effectively triangular shape and moisture may be made available if necessary to render the adhesive capable of transient bonding. Such moisture may be in the atmosphere (if it is sufficiently humid) or may be sprayed onto the collar to activate the transient adhesive on the collar board and tab 22 of the shirt board, so that expansion of the mandrel is also effective in adhering the collar and collar band to the outer and inner surfaces of the collar board and tab 22**.

Figure 6:
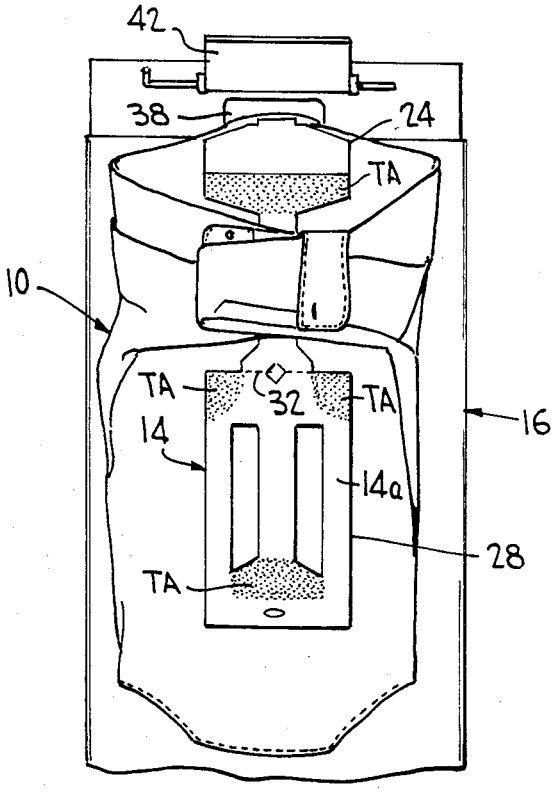
FIGS. 6 through 14 are plan views of the table showing, in sequence, the following steps in the process.
Figure 7:
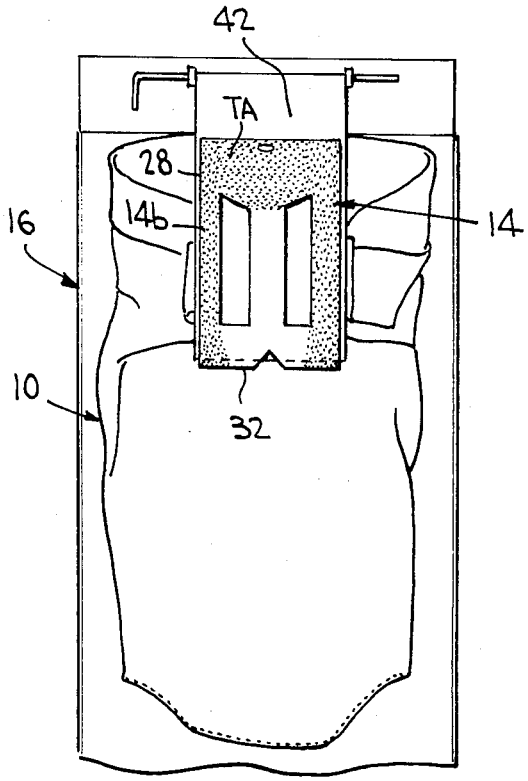
Figure 8:
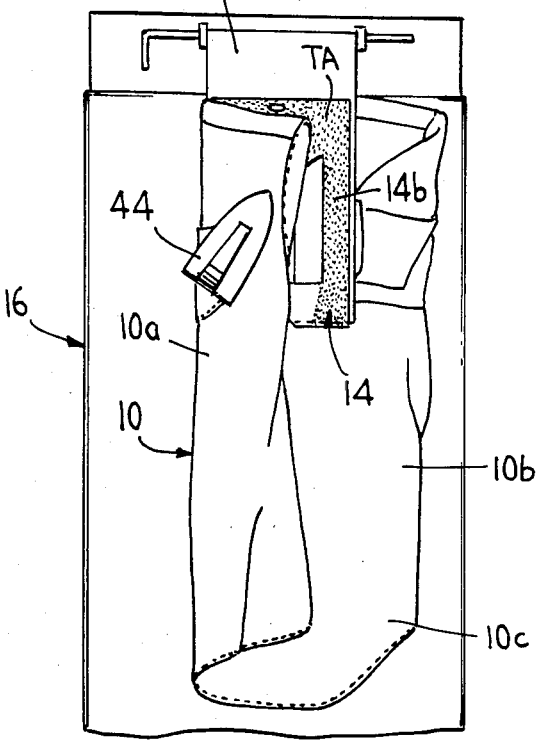
Figure 9:
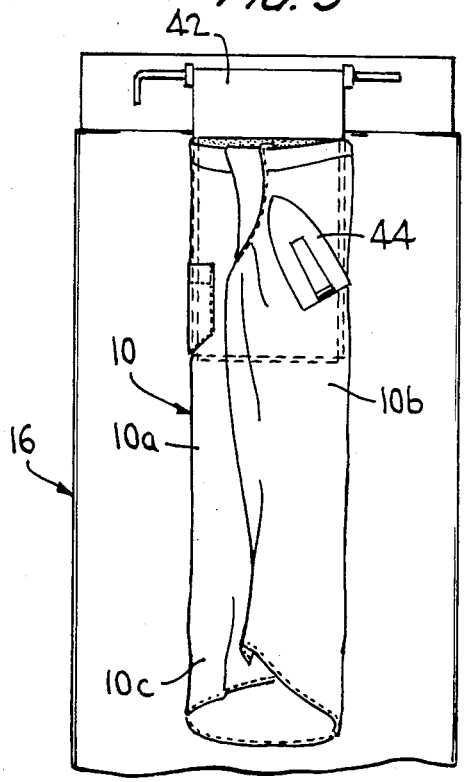
Figure 10:
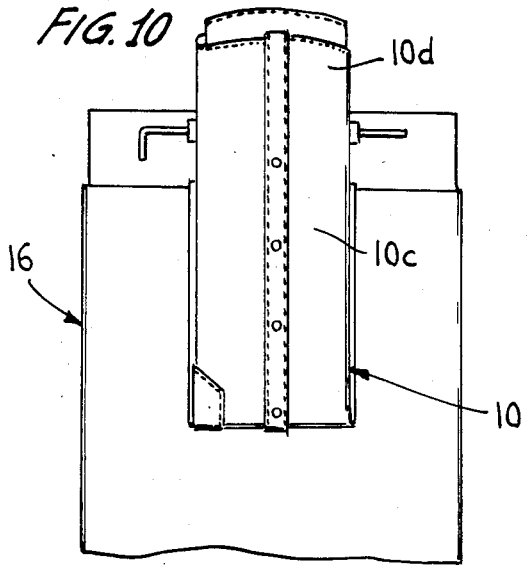
Figure 11:
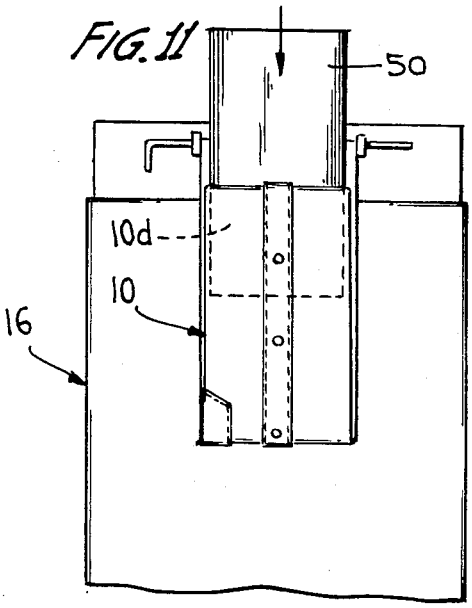

Next, the arms of the shirt are folded in and straightened, FIG. 6, plate 42 is lowered onto the shirt board, and the body portion 28 of the shirt board is folded about line 32 onto the top of the plate as shown in FIG. 7. The area of plate 42 covering the shirt conforms substantially to the area of body portion 28 of the shirt board. Then, as shown in FIGS. 8 and 9, the opposite edge portions of the shirt 10*a* and 10*b* are folded onto the back of the shirt board, straightened, and adhered to the transient adhesive on surface 14*b* of the shirt board by pressing with an iron 44 which may be a steam iron in a dry atmosphere or a regular iron in a humid atmosphere if moisture is necessary. The bottom portion 10*c* of the shirt is then brought up over plate 42, as shown in FIG. 10, and straightened. The folded shirt tail 10d, FIG. 11, is tucked under the shirt board by lifting the shirt board and using a tail tucker 50 as shown in FIG. 11. This completes the folding operations.

Figure 12:
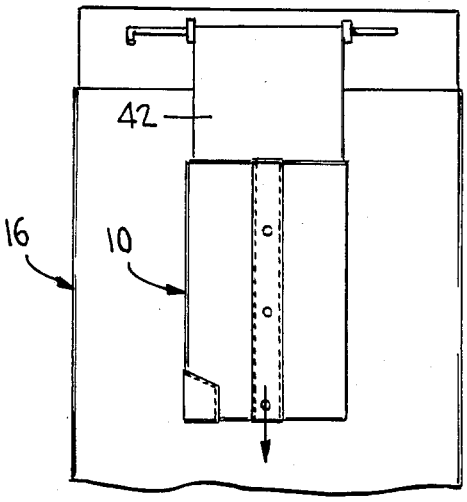
Figure 13:
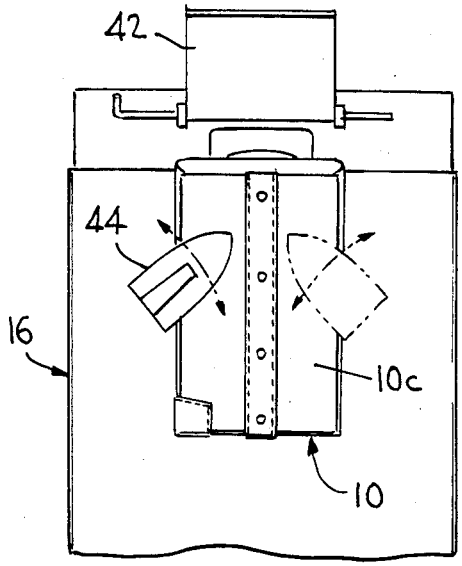
Figure 14:
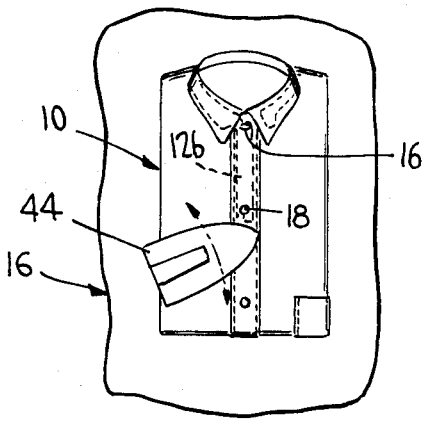

The folded shirt is removed from plate 42 as shown in FIG. 12, and its bottom portion 10*c* is pressed by ironing onto the back surface 14*b* of the shirt board, FIG. 13. Finally, the shirt is turned over and its front pressed as shown in FIG. 14 to adhere same to the transient adhesive coatings on the shirt board and shirt front portion 12*b* of the collar board, and generally to touch up the shirt. It will be understood that where a steam iron is used for providing moisture to activate the transient adhesive on the shirt board and collar board, the porosity of the shirt fabric provides passage for the steam to the adhesive. The shirt is thus formed into a stabilized folded pack, the integrity of which is maintained by adherence of portions thereof to the transient adhesive coatings on the shirt board and collar board. The folded shirt may then be placed in a packaging bag or the like in conventional manner.

It will be appreciated that the invention thus provides a method and means for folding and packaging a shirt which dispenses with the use of mechanical fasteners, yet provides a neat and attractive package. It is also extremely simple to unpackage the shirt, simply by unfolding and pulling it away from the shirt board and collar board. Use of a carefully selected transient adhesive such as disclosed herein will result in substantially no adhesive remaining on the shirt when it is unpackaged.

While only preferred embodiments of the invention have been described herein in detail, the invention is not limited thereby and modifications can be made within the scope of the attached claims.

I claim:

1. A collar board for use in packaging a shirt comprising an elongate collar band-encircling portion and a shorter shirt-front portion extending at an angle from one end of the collar band-encircling portion for encircling substantially an entire shirt collar band, the shirt front portion having a first notch adjacent the collar band encircling portion for engaging a collar button of the shirt, and a second notch spaced from the first notch for engaging another button on the shirt front adjacent the collar button wherein at least the collar band-encircling portion is coated on both surfaces with a transient adhesive wherein the adhesive consists essentially of about 5–25% (w/v) sol of a polyvinyl pyrollidone (PVP ) in an organic solvent having a boiling point less than 90° C. under normal atmospheric conditions, said PVP having a molecular weight ranging from about 30,000 to about 90,000 the resulting composition being a transient cohesive.

2. The invention of claim 1 wherein the second notch is located at a free end of the shirt front portion of the collar board.

3. The invention of claim 1 wherein the collar board is coated with the adhesive over substantially the entire area of both its surfaces.

4. A shirt board of flexible sheet material for use in packaging a shirt wherein the shirt board is coated over selected areas thereof with a transient adhesive wherein the shirt board comprises a collar tab, a shoulder portion of greater width than the collar tab extending from the shoulder portion, and a rectangular body portion extending from the spine portion with a transverse fold line therebetween, the body portion having a length comparable to the combined lengths of the shoulder portion and spine portion wherein the adhesive consists essentially of about 5–25% (w/v) sol of a polyvinyl pyrollidone (PVP) in an organic solvent having a boiling point less than 90° C. under normal atmospheric conditions, said PV having a molecular weight ranging from about 30,000 to about 90,000 the resulting composition being a transient cohesive.

5. The invention of claim 4 wherein the width of the shoulder portion is comparable to the width of the body portion.

6. The invention of claim 4 wherein the body portion has cutout portions.

7. The invention of claim 6 wherein the selected areas are located on both surfaces of the shirt board.

8. A shirt board of flexible sheet material for use in packaging a shirt wherein the shirt board is coated over selected areas thereof with a transient adhesive, wherein the shirt board comprises a collar tab, a shoulder portion of greater width than the collar tab extending from the collar tab, a thin elongate spine portion extending from the shoulder portion, and a body portion extending from the spine portion with a transverse fold line therebetween, the body portion having a length comparable to the combined lengths of the shoulder portion and spine portion, wherein the body portion has cutouts dividing same into three longitudinally extending ribs, wherein the selected areas are locatd on both surfaces of the shirt board, wherein the selected areas on one surface of the shirt board comprise the collar tab, a part of the shoulder portion adjacent the spine portion, corners of the body adjacent the spine portion, and an area at one end of said cutouts remote from the spine portion, and wherein the selected areas on the other surface of the shirt baord comprise the collar tab, corners of the shoulder portion adjacent the collar tab, and a substantial area of the body portion excluding a central one of said ribs and a section of the body portion between the central rib and the spine portion.

9. A shirt board of flexible sheet material for use in packaging a shirt wherein the shirt board is coated over selected areas thereof with a transient adhesive, wherein the shirt board comprises a collar tab, a shoulder portion of greater width than the collar tab extending from the collar tab, a thin elongate spine portion extending from the shoulder portion, and a body portion extending from the spine portion with a transverse fold line therebetween, the body portion having a length comparable to the combined lengths of the shoulder portion and spine portion, wherein the selected areas on one surface of the shirt board comprise the collar tab, a part of the shoulder portion adjacent the spine portion, opposite corners of the body portion adjacent the spine portion, and an area adjacent one end of said body portion which is remote from the spine portion, and wherein the selected areas on the other surface of the shirt board comprise the collar tab, corners of the shoulder portion adjacent the collar tab, and a substantial area of the body portion including longitudinal edge areas of the body portion and an area extending laterally across the body portion at said one end thereof.

10. A product comprising a shirt folded on a shirt board of flexible sheet material to provide a substantially flat rectangular package, wherein the shirt board is coated over selected areas with a transient adhesive, and selected portions of the shirt are adhered to said selected areas for maintaining the integrity of the folded shirt, wherein the shirt board comprises a collar tab, a shoulder portion of greater width than the collar tab extending from the collar tab, a thin elongate spine portion extending from the shoulder portion, and a body portion extending from the spine portion with a transverse fold line therebetween, the body portion having a length comparable to the combined lengths of the shoulder portion and spine portion, wherein the selected areas on one surface of the shirt board comprise the collar tab, a part of the shoulder portion adjacent the spine portion, opposite corners of the body portion adjacent the spine portion, and an area adjacent one end of said body portion which is remote from the spine portion, and wherein the selected areas on the other surface of the shirt board comprise the collar tab, corners of the shoulder portion adjacent collar tab, and a substantial area of the body portion including longitudinal edge areas of the body portion and an area extending laterally across the body portion at said one end thereof.

11. The invention of claim 10 wherein the product includes a collar board inserted between the collar band and collar of the shirt, the collar board also being coated at least in parts with the transient adhesive and adhering to the collar band and collar.

12. The invention of claim 11 wherein the collar board includes a shirt front portion with notches engaged in a collar button and second button of the shirt, the shirt front portion of the collar board being located between the front edge portions of the shirt.

13. A product comprising a shirt folded on a shirt board of flexible sheet material to provide a substantially flat rectangular package, wherein the shirt board is coated over selected areas with a transient adhesive and selected portions of the shirt are adhered to said selected areas for maintaining the integrity of the folded shirt, wherein the adhesive consists essentially of about 5–25% (w/v) sol of a polyvinyl pyrollidone (PVP) in an organic solvent having a boiling point less than 90° C. under normal atmospheric conditions, said PV having a molecular weight ranging from about 30,000 to about 90,000 the resulting composition being a transient cohesive.

* * * * *